United States Patent [19]

Fawcett et al.

[11] 4,376,016

[45] Mar. 8, 1983

[54] BATHS FOR ELECTRODEPOSITION OF METAL CHALCONIDE FILMS

[75] Inventors: William R. Fawcett; Andrzej S. Baranski, both of Guelph, Canada

[73] Assignee: TDC Technology Development Corporation, Vancouver, Canada

[21] Appl. No.: 320,339

[22] Filed: Nov. 16, 1981

[51] Int. Cl.[3] ..... C25D 3/02; C25D 9/08

[52] U.S. Cl. ..... 204/14 N; 204/56 R

[58] Field of Search ..... 204/14 N, 56 R

[56] References Cited

U.S. PATENT DOCUMENTS

| | | | |
|---|---|---|---|
| 602,873 | 4/1898 | Richards et al. | |
| 2,818,374 | 12/1957 | Certa | 204/14 N |
| 3,374,108 | 3/1968 | Keramidas | 117/200 |
| 3,616,280 | 10/1971 | Arnold | 204/14 N |
| 3,884,779 | 5/1975 | Duy et al. | 204/92 |
| 3,888,697 | 6/1875 | Bogus et al. | 136/89 |
| 4,064,326 | 12/1977 | Manassen et al. | 429/111 |
| 4,167,805 | 9/1979 | Castel | 29/572 |
| 4,192,721 | 3/1980 | Fawcett | 204/14 N |
| 4,260,427 | 4/1981 | Fulop et al. | 136/255 |
| 4,261,802 | 4/1981 | Fulop et al. | 204/29 |

FOREIGN PATENT DOCUMENTS

| | | | |
|---|---|---|---|
| 2556716 | 6/1977 | Fed. Rep. of Germany . | |
| 1562163 | 8/1969 | France . | |
| 905888 | 9/1962 | United Kingdom | 204/14 N |
| 2006268 | 5/1979 | United Kingdom . | |
| 2016049 | 9/1979 | United Kingdom . | |

*Primary Examiner*—T. M. Tufariello

*Attorney, Agent, or Firm*—Ridout & Maybee

[57] ABSTRACT

Metal chalconide films having improved photo-electrical properties are obtained from electrodeposition baths containing solvents having a low power for solvating metal cations such that decreased quantities of solvent molecules become intercalated into the chalconide film.

38 Claims, No Drawings

BATHS FOR ELECTRODEPOSITION OF METAL CHALCONIDE FILMS

The present invention relates to electroplating baths for the electrolytic deposition of metal chalconide films.

In our U.S. Pat. No. 4,192,721 dated Mar. 11, 1980 and in our co-pending U.S. patent application Ser. No. 212,863 filed Dec. 4, 1980, we have described a process for electrodeposition of chalconides of the metals Cd, Pb, Hg, Cu, Bi, Co, Ni, Tl, Ag, In, and Fe from a bath comprising an organic polar solvent having dissolved therein an ionised salt of the metal moiety of the metal chalconide to be deposited, and the chalcogen in elemental form.

By the said process, smooth (non-dendritic) coherent films of metal chalconides may be obtained that, depending on the chemical composition of the film deposited, may be p- or n-type semiconductors or may be metallic conductors. Thus, for example Nis and CoS are metallic-type conductors while CdS, CdSe, $Bi_2S_3$, HgS, PbS, $Cu_2S$, and $Tl_2S$ are semiconductors. The semiconductive films obtained by this process have properties that render them suited for use in the manufacture of photovoltaic devices, e.g., photovoltaic cells. Thus, for example, by forming an n-type semiconductive layer on a p-type semiconductive chalconide obtained by the electrodeposition process, a photovoltaic cell having an n-p junction may be obtained, and by forming a conductive barrier layer on the semiconductive chalconide film, a Schottky barrier layer cell may be obtained.

From physical examination of the films obtained by the above electrodeposition process, it has now been found that quantities of the organic polar solvent tend to become intercalated into the metal chalconide layer during the electrodeposition process. Such intercalation is revealed by heating a sample of the prepared film under an inert atmosphere for example argon, at an elevated temperature e.g. at 700° C. for a period sufficient to pyrolize solvent residues remaining within the film, and then etching or dissolving away the film e.g. with concentrated hydrochloric acid. The solvent is thereby decomposed into carbon which is insoluble in HCl and can be observed under the microscope as black particles.

In accordance with this invention, it has been found that the intercalation of solvent molecules into the film is undesirable, as it impairs the photoelectric efficiency. More particularly, it has been found that the presence of solvent molecules causes the formation of "deep traps" within semiconductive films. The magnitude of the electric current generated when a photovoltaic cell is exposed to radiation in the appropriate wavelength range, (i.e. having $h\nu >$ the band gap energy of the semiconductor, where h is Planck's constant and $\nu$ is the frequency of the radiation) depends on the generation of charge carriers, i.e. electrons and electron holes, and on the free migration of these charge carriers through the layers of the cell. The above-mentioned deep traps can, however, re-combine with photoelectrically-generated charge carriers, and therefore impair the photo-electric efficiency as they limit the electric current generated when a photoelectric device incorporating the semiconductive films is exposed to excitation radiation.

The degree to which any given solvent tends to be intercalated into an electrolytically-grown chalconide film, i.e. the power of intercalation of the solvent into metal chalconide, can be readily determined empirically by carrying out trial electrodepositions using as the bath solvent say dimethylsulfoxide (DMSO) and the solvent under test, respectively, and annealing and etching the film obtained to reveal under microscopy the carbon residues of the solvent molecules. It has been found that the power of intercalation of the solvent varies in a definite manner according to the solvent which is employed. For example ethylene glycol, which is disclosed in our prior patent, has a considerably lower power of intercalation into metal chalconide films than DMSO.

By investigation of various polar organic solvents as described above there has now been derived a class of novel solvents for use in the electrodeposition bath for deposition of metal chalconides. Solvents in the said class are characterized by the solvent having a power of intercalation into metal chalconide lower than that of dimethylsulfoxide (DMSO), and by having a power for dissolving elemental chalcogen greater than that of ethylene glycol (EG).

The present invention therefore provides a bath for the electrodeposition of metal chalconides comprising an organic polar solvent having dissolved therein (a) an ionized salt of at least one metal selected from the group consisting of Cd, Pb, Hg, Cu, Bi, Co, Ni, Tl, Ag, In, and Fe, and (b) at least one chalcogen in elemental form selected from the group consisting of S and Se said solvent being characterized by having a power of intercalation into metal chalconide films electrodeposited therefrom lower than that of dimethylsulfoxide, and having a power for dissolving elemental chalcogen greater than that of ethylene glycol.

The solvents employed in the present baths have the further advantage that, owing to the quantities of chalcogen that may be maintained in solution, good quality non-dendritic coherent films may be obtained at satisfactory rates of deposition. As discussed in more detail in our above-mentioned patent, the presence of greater amounts of chalcogen dissolved in the solution results in there being a greater availability of chalcogen present for reaction with metal species in the bath to yield the solid metal chalconide deposit and permits higher electroplating current densities to be employed, thus leading to more rapid deposition of the film, while still yielding a film of good quality. The solubility of chalcogens in particular solvents can of course be readily tested by conventional solubility determination methods. In view of the close chemical analogies between the chalcogens S and Se it is unnecessary to test the solubility of each of these chalcogens in the solvent under investigation and it is sufficient to test solubility of sulfur in the solvent, as poor solubility of sulfur in the solvent will indicate unsuitability of the solvent. Chalgogens exhibit relatively poor solubility in ethylene glycol but exhibit relatively good solubility in DMSO. As noted above the solvents to be employed in this invention exhibit better solubility for chalcogens than ethylene glycol and are intercalated into chalconide films to a lesser extent than DMSO.

Desirably, the solvents are capable of dissolving at least about 0.15 g sulfur, more preferably at least about 0.2 g of sulfur, per 100 ml of solvent at 120° C. In order to conduct the electrodeposition successfully, to achieve non-dendritic, coherent, good quality deposits of chalconide at preferred current densities of about 2.5 $mA/cm^2$, the optimum range of dissolved sulfur content in the bath is from about 0.16 to about 0.3 g per 100 ml of electrolyte.

One example of a class of preferred solvents comprises the oligomeric and polymeric ethylene glycols of formula $$HO(CH_2CH_2O)_nCH_2CH_2OH \quad (I)$$

wherein n is 1 to about 20, more preferably 1 to about 12 and mixtures thereof. Examples include the oligomeric glycols, diethylene, triethylene, and tetraethylene glycols, and the polymeric polyethylene glycol Carbowaxes (trade mark), for example PEG (polyethylene glycol) 400, which comprises a mixture of polyethylene glycols wherein n is about 6 to about 12, and having an average molecular weight of about 400.

A further preferred class of solvents comprises the mono alkyl ethers of ethylene glycol of formula $$C_nH_{2n+1}-0-CH_2CH_2OH \quad (II)$$

wherein n is 1 to about 10 more preferably 1 to about 5, and mixtures thereof. Examples include the methyl, ethyl, and butyl Cellosolves (trade mark) wherein n is 1, 2, and 3, respectively.

Desirably, the molecular weights of the solvents employed are not excessively high i.e. n in formula (I) is not in excess of about 20, more preferably not in excess of about 10, and n in formula (II) is not in excess of about 10, more preferably not in excess of about 5, as with increasing molecular weights, although the solubility of sulfur and other chalogens increases, the solubility of metal salts decreases and therefore the electrical conductivity of the bath decreases thus reducing the efficiency of the chalconide electrodeposition process. Further, with increasing molecular weight, the viscosity of the solvent increases so that there is reduced transport of the reactive species through the bath. This limits the current densities that can be employed during the electrodeposition process since if the current density is increased above a certain level undesired side reactions occur, such as decomposition of the solvent, thus reducing the efficiency of the process.

It has been found that the chalcogen tellurium is practically insoluble in these preferred solvents, and in most instances the chalcogen selenium is only poorly soluble in them. These solvents are therefore suitable for deposition of metal sulfides and to a lesser extent metal selenides but as far as can presently be determined are not suitable for deposition of metal tellurides.

In the preferred form, the said solvents are characterized by having a relatively low donor number N, the donor number N being defined (as in "The Donor-Acceptor Approach to Molecular Interactions", V. Gutmann, Plenum Press, 1978, p. 19) as the molar enthalpy value for the reaction of the donor D (solvent) with $SbCl_5$ as a reference acceptor in a $10^{-3}$ M solution of dichloroethane, $$D+SbCl_5 \rightleftharpoons D{\cdot}SbCl_5(-\Delta H_{D.SbCl_5}=N)$$

The donor number N is a measure of the readiness with which the solvent solvates cations. Solvents which strongly solvate cations tend to be intercalated into the deposited metal chalconide films to a greater extent as they tend to be more strongly associated with the reactive species of the metal moiety of the metal chalconide at the point at which this undergoes the deposition reaction. The preferred class of solvents therefore have a donor number which is not substantially higher than that of ethylene glycol (N approx. 19). As noted above ethylene glycol has a power of intercalation considerably less than that of DMSO. The donor numbers of the above-mentioned oligomeric and polymeric glycols and ethers of glycols, for example, have donor numbers approximately the same as that of ethylene glycol.

Advantageously, the baths of the invention contain small additions of water of up to about 20% (based on the total volume of electrolyte) more preferably up to about 15%. Water has a high donor number and therefore the presence of water in the bath diminishes the quantity of organic solvent molecules intercalated in the chalconide films as the water becomes intercalated preferentially to the organic solvent molecules. The water molecules can, however, be removed from the film more readily than the organic solvent molecules by low temperature annealing of the film after the completion of the electrodeposition. The annealing is preferably conducted in an inert atmosphere e.g. argon at about 150° C. to 250° C., more preferably about 200° C., and is conducted for a period sufficient to evaporate substantially all water from the film, preferably for about 30 minutes.

The films deposited from baths containing small additions of water have a different morphology from films grown from anhydrous baths, in that their surface is of slightly roughened, matte appearance, although the general surface of the film is still of a generally smooth, that is to say non-dendritic, configuration. Films having a slightly roughened surface can be employed with advantage in photo-electric applications, as this surface is less reflective and can therefore absorb more of the incident radiation.

The presence of water in the bath decreases the solubility of the elemental chalcogen but, with the preferred class of solvents of the invention, which have better powers of dissolving chalcogen than ethylene glycol, does not reduce the concentration of dissolved chalcogen below the level at which unacceptably low current densities need to be employed to obtain good quality chalconide films. For example, addition of 10% water by volume into diethylene glycol decreases the solubility of sulfur about two times, but still permits sufficient sulfur to be dissolved in the bath to permit satisfactory current densities and deposition rates.

It is accordingly preferred to employ water-miscible solvents that are non-reactive with water, and the use of solvents which are hydrolyzed in contact with water is therefore preferably avoided. It may be noted that the preferred oligomeric and polymeric ethylene glycols and the ethylene glycol ethers discussed above are miscible with and stable with respect to water whereas the solvent dimethylformamide disclosed in our above-mentioned patent and patent application is hydrolyzed in contact with water.

Increased photoelectric efficiency of photovolatic devices fabricated from the semiconductive chalconide films can be obtained by doping the semiconductor with electron donor ions. In the present electrodeposition baths, we have found that these donor ions may be conveniently introduced into the films by including salts in the bath composition which yield ions that become incorporated in electrodeposited films. The donor ions become incorporated in the metal chalconide at normal lattice sites i.e. they occupy sites in the crystal lattice which would normally be occupied by metal or chalconide ions of the metal chalconide itself, and in this respect are different from intercalated species such as the intercalated solvent molecules discussed above in that the intercalated species occupy interstitial positions between the normal crystal lattice sites. The electron donor ions are to be selected so that they provide discrete electron energy levels just below the conduction band of the semiconductive metal chalconide which is being deposited. These electron energy levels are easily promoted into the conduction band and therefore serve to increase the number of charge carriers when the device is irradiated with radiation in the appropriate wavelength range. Examples of donor ions include halide ions and thallium ions. In our above-mentioned co-pending patent application we have described deposition of a metal chalconide doped with thallium ions. The use of halide ions as the dopant is however preferred in the baths of the present invention owing to the widespread availability and low cost of halide compounds.

Further, we have found the presence of substantial quantities of halide ion in the baths is advantageous as it increases the conductivity in the bath. Baths of low conductivity tend to yield non-uniform deposits. Desirably, in order to achieve a high concentration of halide ions in the bath, the metal of the metal chalconide to be deposited is added to the bath in the form of a metal halide, and supplementary halide compounds are added to the baths to serve as a source of electron donor ions and to increase the conductivity of the bath. The metal halides and supplementary halide compounds are preferably chlorides as chloride ion has superior electrolytic stability. Bromides and iodides are less desirable because of their greater tendency to oxidize to the elemental halogen and become evolved from the bath.

The bath of the present invention should preferably not contain excessively large quantities of halide ion, since normally it is desired to maintain the semiconductive character of the metal chalconide deposit and if excessively large quantities of halide ion become incorporated into the film, this acquires the character of a mixed crystal film of metal halide/metal chalconide. Desirably, therefore, the bath contains from about 0.01 to about 0.5 mole of halide ion, more preferably about 0.05 to about 0.2 mole, still more preferably about 0.08 to about 0.2 mole of halide ion per 100 ml.

The supplementary halide compounds are preferably added to the bath in the form of ammonium salts or other halide salts having cations that in the solid state can be substantially completely volatilised from the metal chalconide film by heating, for an appropriate period e.g. by low temperature annealing as discussed above, preferably in an inert atmosphere at 200° C. for 30 minutes. The use of alkali metal halides or other halides having non-volatilisable cations is less desirable as the metal salt residues remaining in the film tend to be hygroscopic thus rendering devices manufactured employing the chalconide films more prone to short-circuiting as a result of moisture being attracted to the film. In the preferred form, the solvents employed in the present baths are capable of dissolving at least about 0.01 moles chloride ion (added as $NH_4Cl$) more preferably at least about 0.05 moles chloride ion still more preferably at least about 0.08 moles chloride ion per 100 ml at 120° C. and the use of solvents which are decomposed by $NH_4Cl$, which has a slightly acidic reaction, or in which $NH_4Cl$ is poorly soluble, is preferably avoided. It may be noted that the preferred oligomeric and polymeric glycols and the ethylene glycol ethers discussed above are stable with respect to $NH_4Cl$ and are capable of dissolving relatively large amounts of $NH_4Cl$ e.g. at least about 0.09 moles of $NH_4Cl$ per 100 ml at 120° C., whereas DMSO is decomposed in contact with $NH_4Cl$, and the solvent propylene carbonate disclosed in our above mentioned patent and patent application is capable of dissolving only relatively small quantities of $NH_4Cl$.

With the preferred oligomeric and polymeric ethylene glycols and ethylene glycol ethers discussed above and depending on the nature of metal moiety of the metal chalconide being deposited, in order to obtain good quality deposits of metal chalconide it may be desirable to include in the bath composition quantities of halide ion such that at least a certain molar ratio of halide ion to metal ion is obtained. For example, in the case of deposition of cadmium chalconide from these solvents, the molar ratio of chloride ion to cadmium ion should be at least about 15:1 in order to obtain electrodeposition of the cadmium chalconide film on the cathode. Without wishing to be bound by any theory it is suggested that, in the case of deposition of cadmium chalconides, the electrodeposition process proceeds via a one valent state of cadmium ion ($Cd+$ or $Cd_2^{2+}$) and, in the presence of only weakly solvating solvent molecules, this state can be stabilised by the presence of halide ions which act as ligands. In the case of the deposition of other metal chalconides e.g. in the deposition of bismuth chalconides, these large molar ratios of halide ions are not necessary in order to achieve satisfactory deposits, or satisfactory deposits may be obtainable in the presence in the bath of anions other than halide, e.g. methylsulfonate anions.

The chalconide films electrodeposited from the baths of the present invention may exhibit significantly higher photoelectric efficiency than those obtained from the baths described in our above-mentioned patent and patent application, owing to the lower tendency for their solvent molecules to become intercalated into the film, and, particularly in the case in which the preferred solvents are employed, owing to the ability of the baths to accept in solution substantial quantities of halide or other electron donor ion.

In general, owing to the relative absence of deep traps in the deposited films and owing to the increased concentrations of donor ions which can be obtained in the deposited films, the films exhibit photoresistivities, i.e. the resistivity when the films are exposed to radiation of the appropriate wavelength, which are markedly lower than those of the prior-deposited films, and, more specifically, the resistivities of the films drop more rapidly following their illumination with radiation of the appropriate wavelength. For example, the photoresistivity in ohm.cm of films deposited from DMSO is typically about 1000 times that of films deposited from the preferred solvents disclosed herein, employing optimum conditions for the electrodeposition from the particular solvent in each case. In general, photovoltaic cells fabricated from films obtained from the present baths exhibit under standard conditions of illumination short circuit currents which are markedly greater than those obtained from devices prepared from films deposited from the prior baths.

With respect to the details of the contents of metal salt and chalcogen to be dissolved in the baths of the invention, and with respect to the details of the method of carrying out the electrode position process, the baths may be formulated and used generally in accordance with the procedures described in our above mentioned patent application Ser. No. 212,863 filed Dec. 4, 1980, the disclosures of which are incorporated herein by reference in this regard.

Generally, the method of electrodeposition using the baths of the present invention comprises subjecting the bath to electrolysis at such temperature and at a current density that is sufficiently low with respect to the surface area of the cathode that a non-dendritic coherent film of the metal chalconide is deposited on the cathode; and continuing the electrolysis until a desired thickness of film has built up on the cathode. In some cases it is necessary to maintain the bath at elevated temperature, e.g. at 80° to 150° C. in order to obtain a good quality film. It has been found, however, that with certain of the preferred solvents employed in the baths of the present invention, good quality deposits of metal chalconides can be obtained at bath temperatures lower than those we have described in our above-mentioned patent and patent application. For example, in the case of deposition of cadmium sulfide from a bath containing as solvent 2-ethoxyethanol, the electrodeposition may be conducted satisfactorily at room temperature and in the case of deposition of bismuth sulfide from a bath containing diethylene glycol as solvent, the bath should preferably be maintained at a temperature below about 100° C., more preferably about 80° to 100° C., as with temperatures much in excess of 100° C. undesired dendritic growth of the chalcomide film occurs. When these relatively low bath temperatures are employed it is, however, desirable that the bath be substantially anhydrous or should contain only small amounts of water, preferably less than 1% water by volume based on the volume of the bath, since at lower temperatures the solubility of the chalcogen in the bath is relatively low and in the presence of water it is difficult to dissolve sufficient to of the chalcogen to permit the electrodeposition to be conducted at the normally-desired current densities.

The optimum temperature for the bath can of course be readily determined for any given solvent by carrying out electrodeposition trials at differing bath temperatures. Although the above-described baths are employed to their greatest advantage in the electrodeposition of semiconductive films e.g. of CdS, CdSe, $Bi_2S_3$ HgS, PbS, $Cu_2S$, and $Tl_2S$, they may be similarly employed for electrodeposition of films having metallic-type conductivity e.g. of NiS or CoS and as such offer a useful alternative to the baths described in our prior patent and patent application.

Some Examples of bath recipes and electrodeposition processes will now be given. The processes for electrodeposition were conducted employing apparatus and under the conditions as described in more detail in our above-mentioned U.S. Pat. No. 4,192,721. In each case, good quality films are obtained.

EXAMPLE 1

Deposition of a CdS film.
100 ml DEG*
0.2 g S
1 g $CdCl_2$
5 g $NH_4Cl$ or $NH_4Br$
Temp=120° C.
Current density=3 mA $cm^{-2}$

EXAMPLE 2

Deposition of an improved CdS film, exhibiting improved photoelectric efficiency
90 ml DEG*
10 ml water
0.1 g S
1 g $CdCl_2$
5 g $NH_4Cl$
Temp=120° C.
Current density=3 mA $cm^{-2}$

EXAMPLE 3

Deposition of a CdS-ZnS film.
100 ml DEG*
0.2 g S
3 g $NH_4Cl$
0.6 g $CdCl_2$
1 g $ZnCl_2$
Temp=120° C.
Current density=3 mA $cm^{-2}$
The deposit obtained contains 14 atomic % Zn.
*diethylene glycol

EXAMPLE 4

Deposition of a CdS film.
100 ml 2EE**
0.3 g S
2 g NaI
2 g $CdI_2$
Temp=room
Current density=3 mA $cm^{-2}$
**2-ethoxyethanol

EXAMPLE 5

Deposition of a CdS film
100 ml PEG 400***
1 to 5 g $NM_4Cl$(optimum 2.5 g)
1 g $CdCl_2$
0.2 g S
5 to 10 g $H_2O$ (optimum 5 G)
Temp=120° C.
Current density=3 mA $cm^{-2}$
***polyethylene glycol of average molecular weight 400 obtained under the trade mark Carbowax

EXAMPLE 6

Deposition of a $Bi_2S_3$ film
100 ml DEG*
0.5 to 5 g $NH_4Cl$ or $NH_4Br$ (preferably 1 g)
1.5 g $BiCl_3$
0.2 g S
Temp=80° to 100° C.
Current density=0.5 to 3 m A/$cm^2$.
Note: temperatures over 100° C. cause dendritic growth of the solvent. $H_2O$ can be present in amounts <1%.
*diethylene glycol

EXAMPLE 7

Using the deposition process of Example 2, a CdS film was deposited on a 1.2×1.5 cm Ni/Cd substrate obtained by electrodepositing cadmium by conventional methods in a thin layer (approximately 5 microns) on a nickel cathode.

In order to obtain $Cu_2S$/CdS photoelectric bilayer on the surface of the film, the film was then subjected to a hot dip ion exchange process by dipping it for 30 sec into a solution of 0.5 g Cu I and 3 g $NH_4Cl$ in 100 ml ethylene glycol. During immersion $Cd^{++}$ ions from the surface layer are replaced by $Cu^+$ ions and a layer of $Cu_2S$ of approximately 0.3 micron thickness is developed on top of the CdS. The film is then washed with ethylene glycol and acetone and is air dried, and is then annealed in argon at 200° C. for 30 min.

An electrical contact is provided by glueing a copper ring 0.7 cm in diameter on the $Cu_2S$ surface, using silver epoxy.

The resulting photovoltaic cell produced a short circuit current of 3.2 mA when illuminated at 75 $mW/cm^2$.

We claim:

1. A bath for the electrodeposition of metal chalconides comprising an organic polar solvent having dissolved therein (a) an ionized salt of at least one metal selected from the group consisting of Cd, Pb, Hg, Cu, Bi, Co, Ni, Tl, Ag, In, and Fe, and (b) at least one chalcogen in elemental form selected from the group consisting of S and Se said solvent being characterized by having a power of intercalation into metal chalconide films electrodeposited therefrom lower than that of dimethylsulfoxide and having power for dissolving elemental chalcogen greater than that of ethylene glycol.

2. A bath as claimed in claim 1 wherein the solvent is selected from the group consisting of glycols of the formula $$HO(CH_2CH_2O)_nCH_2CH_2OH \quad (I)$$

wherein n is an integer from 1 to about 20, and glycol ethers of the formula $$C_nH_{2n+1}-O-CH_2CH_2OH \quad (II)$$

wherein n is an integer from 1 to about 10, and mixtures thereof.

3. A bath as claimed in claim 2 wherein the solvent is a glycol of the formula (I), wherein n=1 to about 20.

4. A bath as claimed in claim 3 wherein n in formula (I) is an integer from 1 to about 12.

5. A bath as claimed in claim 4 wherein said glycol is diethylene glycol.

6. A bath as claimed in claim 4 wherein said glycol comprises a mixture of polyethylene glycols of formula (I) wherein n is about 6 to about 12 and having an average molecular weight of about 400.

7. A bath as claimed in claim 2 wherein the solvent is a glycol ether of the formula (II) wherein n=1 to about 10.

8. A bath as claimed in claim 7 wherein n in formula (II) is 1 to about 5.

9. A bath as claimed in claim 8 wherein said glycol ether is 2-ethoxy ethanol.

10. A bath as claimed in claim 1 wherein donor number N of the solvent is not substantially higher than 19.

11. A bath as claimed in claim 1 wherein the donor number of the solvent is about 19.

12. A bath as claimed in claim 1 in which the solvent is capable of dissolving at least about 0.15 g of sulfur per 100 ml at 120° C.

13. A bath as claimed in claim 12 wherein the solvent is capable of dissolving at least about 0.2 g of sulfur per 100 ml at 120° C.

14. A bath as claimed in claim 13 having dissolved therein about 0.16 to about 0.3 g of elemental chalcogen per 100 ml of the bath.

15. A bath as claimed in claim 1 or 14 wherein said elemental chalcogen is sulfur.

16. A bath as claimed in claim 1 wherein the solvent is water-miscible and is non-reactive with water.

17. A bath as claimed in claim 16 containing up to about 20% by volume water.

18. A bath as claimed in claim 17 containing up to about 15% by volume water.

19. A bath as claimed in claim 1 having dissolved therein a salt yielding an electron donor ion for the metal chalconide electrodepositable from the bath.

20. A bath as claimed in claim 1 wherein the electron donor-yielding salt is a halide.

21. A bath as claimed in claim 20 wherein the cationic moiety of the halide is heat-volatilisable in the solid state.

22. A bath as claimed in claim 21 wherein the halide is an ammonium halide.

23. A bath as claimed in claim 20, 21, or 22 wherein the halide is a chloride.

24. A bath as claimed in claim 20 containing from about 0.01 to about 0.5 mole of halide ion per 100 ml.

25. A bath as claimed in claim 24 containing from about 0.05 to about 0.2 mole of halide ion per 100 ml.

26. A bath as claimed in claim 25 containing from about 0.08 to about 0.2 mole of halide ion per 100 ml.

27. A bath as claimed in claim 20 wherein the solvent is capable of dissolving at least about 0.01 moles of $NH_4Cl$ per 100 ml at 120° C.

28. A bath as claimed in claim 27 wherein the solvent is capable of dissolving at least about 0.05 moles of $NH_4Cl$ per ml at 120° C.

29. A bath as claimed in claim 28 wherein the solvent is capable of dissolving at least about 0.08 moles of NH Cl per 100 ml 120° C.

30. A bath as claimed in claim 1 wherein said at least one ionized salt comprises a cadmium salt, and the bath contains halide ion in a molar ratio halide ion:cadmium ion of at least about 15:1.

31. A method for producing a non-dendritic coherent film of metal chalconide comprising subjecting a bath as claimed in claim 1 to electrolysis at such temperature and at a current density that is sufficiently low with respect to the surface area of the cathode that a non-dendritic coherent film is deposited in the cathode; and continuing the electrolysis until a desired thickness of film has built up on the cathode.

32. A method as claimed in claim 31 for producing a cadmium sulfide film wherein the solvent is 2-ethoxyethanol, the dissolved metal salt is a cadmium salt, and the dissolved chalcogen is sulfur, and the electrodeposition is conducted at room temperature.

33. A method as claimed in claim 31 for producing a bismuth sulfide film wherein the solvent is diethylene glycol, the dissolved metal salts is a bismuth salt, and the dissolved chalcogen is sulfur, and the electrodeposition is conducted at a temperature below about 100° C.

34. A method claimed in claim 33 wherein the temperature is about 80° C. to about 100° C.

35. A method as claimed in claim 31 wherein the bath composition includes up to about 20% by volume water, and including the step of subsequently annealing the film in an inert atmosphere for a period sufficient to evaporate substantially all water from the film.

36. A method as claimed in claim 31 for producing a halide-doped film wherein the bath composition has dissolved therein an ammonium halide, and including the step of subsequently annealing the film in an inert atmosphere for a period sufficient to volatilise substantially all ammonium ion therefrom.

37. A method as claimed in claim 35 or 36 wherein the annealing is conducted at a temperature of from about 150° to 250° C. for about 30 minutes.

38. A method as claimed in claim 35 or 36 wherein the annealing is conducted at a temperature of about 200° C. for about 30 minutes.

* * * * *